United States Patent [19]

Chisaki et al.

[11] Patent Number: 4,626,202

[45] Date of Patent: Dec. 2, 1986

[54] ROTARY KILN

[75] Inventors: Tatsu Chisaki, Tokyo; Toshio Ikenaga, Yokohama; Akira Iwabuchi, Tokoro, all of Japan

[73] Assignees: Chisaki Co., Ltd., Tokyo; Kunneppu Sekkai Kogyo Incorporated, Hokkaido; Daizo Kunii, Tokyo, Japan

[21] Appl. No.: 811,533

[22] Filed: Dec. 20, 1985

[30] Foreign Application Priority Data

Dec. 24, 1984 [JP] Japan ..... 59-270927

[51] Int. Cl.[4] ..... F27B 7/08; F27B 7/10

[52] U.S. Cl. ..... 432/107; 34/109; 165/88; 165/89; 110/246

[58] Field of Search ..... 432/103, 107; 165/89, 165/88; 34/109; 110/246

[56] References Cited

U.S. PATENT DOCUMENTS 3,294,384 12/1966 Hollefriend ..... 432/107

3,430,936 3/1969 Metzger ..... 165/88

4,376,343 3/1983 White et al. ..... 34/109

*Primary Examiner*—Edward G. Favors

*Attorney, Agent, or Firm*—Rosen, Dainow & Jacobs

[57] ABSTRACT

A rotary kiln includes a cylindrical kiln body supported for rotation about a central axis inclined with respect to a horizontal plane, a cylindrical combustion chamber formed inside the kiln body and extending along the central axis, and a plurality of cylindrical calcination chambers formed inside the kiln body so as to lie parallel with and surround the combustion chamber. The combustion chamber has an outlet at its lower end from which residue produced by combustion of fuel inside the combustion chamber drops for further combustion and/or discharge. Each calcination chamber has an inlet at its elevated end for receiving a supply of raw material to be calcined inside the calcination chamber, an opening at its lowermost end communicating with the outlet of the combustion chamber for receiving high-temperature combustion gases from the interior of the combustion chamber, and an outlet adjacent its lowermost end from which the calcined raw material drops for further calcination and/or collection without contacting the residue from the combustion chamber. Calcination in the calcination chambers is effected by heat transmitted from the combustion chamber through the kiln body and by heat given off by the high-temperature gases received from the combustion chamber.

7 Claims, 7 Drawing Figures

1
2
3
4
5
6
7
8
9
9'
10
11
12
13
13A
14
14A
15
16
17
18
19
20
21
22
23
23'
50
61
62
65
B
C

ROTARY KILN

BACKGROUND OF THE INVENTION

1. Field of the Invention

This invention relates to a rotary kiln for calcining loose bulk materials by application of heat during rotation.

2. Description of the Prior Art

The conventional rotary kiln comprises a simple cylinder installed at an incline. Raw material feed to be calcined by the application of heat is charged into the kiln from an inlet at the elevated end, the feed is calcined by applying heat while the cylinder is rotated, and the calcined product is discharged from an outlet at the lower end. To provide a source of heat for effecting calcination, combustion gases obtained by burning a combustible material near the outlet of the cylinder are introduced into the kiln from the outlet and move countercurrent to the flow of feed along the cylinder. Though kilns of this type are advantageous in that they are capable of treating raw materials of many different kinds and of a wide variety of particle diameters, the raw material is allowed to come into direct contact with the ash-containing combustion gases. As a result, the ash content mixes with the raw material and detracts from the quality of the final product, especially in cases where coal having a high ash content is used as the combustible material. In particular, using a waste having a high content of unburned inorganic substances as the combustible material can cause so much ash to mix with the calcined product as to render the product unusable.

Moreover, a rotary kiln of simple cylindrical construction presents a small heat receiving surface area per unit length of the kiln in comparison with the amount of heat given off by the kiln. This makes it necessary for the rotary kiln to be of considerable length in order that a sufficient amount of thermal energy derived from the flame and combustion gases may be transmitted to the raw material. However, a disadvantage of rotary kilns of greater length is an increase in the amount of heat given off by the outer surface of the kiln, thus making it impossible to improve heating efficiency.

Several configurations for burning the combustible material are available. These include a fire grate arrangement in which the combustible material is burned on a grate, a fluidized bed set-up in which the raw material feed and combustible material are mixed together and burned while being made to flow, and an arrangement in which a burner is used. The fire grate allows finely divided combustible materials to fall through the interstices of the grate and is therefore ill suited for such materials. The fluidized bed and burner arrangements can only be applied to granulated coal and finely divided coal, respectively, and therefore place a limitation upon the types of combustible material that can be used.

SUMMARY OF THE INVENTION

An object of the present invention is to provide a rotary kiln that solves the aforementioned problems encountered in the prior art.

Another object of the present invention is to provide a rotary kiln that greatly improves upon heating efficiency while maintaining the quality of the raw material to be calcined.

A further object of the present invention is to provide a rotary kiln having a wide field of application made possible by the capability of employing any kind of combustible material as a source of heat.

According to the present invention, the foregoing objects are attained by providing a rotary kiln having a cylindrical kiln body supported for rotation and arranged with its central axis inclined with respect to the horizontal. Though the angle of inclination and revolving speed of the kiln body are decided along with the degree of calcination and processing capability, typical figures are 0.2°–10° and 0.1–30 rev/min, respectively. The kiln body is formed to include an axially extending combustion chamber of generally cylindrical shape and a plurality of axially extending calcination chambers of generally cylindrical shape surrounding the combustion chamber. The space between the combustion chamber and each of the calcination chambers is filled with a material exhibiting excellent heat transfer and temperature resistance. The combustion chamber, which is located along the central axis of the kiln body, has an inlet at its elevated end for receiving a fuel to be burned inside the combustion chamber, and an outlet at its lower end for discharging the residue from combusted fuel that descends along the combustion chamber. The fuel used may be a combustible material such as coal or combustible waste of a suitable particle size or a combustion gas.

The calcination chambers surround the combustion chamber and lie parallel thereto. Each calcination chamber has an inlet at its elevated end and an outlet at its lower end. A raw material to be calcined is charged into each calcination chamber from the corresponding inlet and is calcined into a final product inside the calcination chamber before being discharged from the corresponding outlet by descending along the chamber. Needless to say, the inlet to the combustion chamber is provided separate from the inlets to the calcination chambers, and the combustion chamber outlet is provided separate from the outlets of the calcination chambers, so as to prevent the fuel from mixing with the raw material.

Each calcination chamber is further provided at its lower end with an end opening separate from the calcination chamber outlet, and it communicates with the outlet of the combustion chamber. In this connection, it will suffice if the lower end of the combustion chamber and the lower end of each calcination chamber are brought into communication under a condition in which the descending combustion residue and raw material do not mix.

In an embodiment of the invention, an auxiliary combustion chamber is provided beneath the combustion chamber outlet in surrounding relation to receive the combustion residue discharged from the combustion chamber outlet, thereby to burn any unburnt substances that might be contained in the residue. The auxiliary combustion chamber can be provided with combustion air supply pipes. Attached to the lowermost portion of the auxiliary combustion chamber are a valve and discharge pipe for discharging residue that results from complete combustion of the fuel.

To heighten the degree of raw material calcination, a curing chamber may be provided in surrounding relation below the outlets of the calcination chambers for receiving the calcined product that drops from these outlets to cure the product by exploiting the sensible heat possessed by the product proper. A cooling chamber communicating with the curing chamber is provided therebelow. Attached to the lowermost portion of the cooling chamber are an extraction valve and extraction pipe for successively extracting a cooled, calcined material as the final product.

To perform calcination by means of the rotary kiln having the foregoing construction, the kiln body is set into rotation, the fuel and combustion air are introduced into the combustion chamber from its inlet, and the raw material is charged at a predetermined feed rate into the calcination chambers from their corresponding inlets. The fuel is burned uniformly while tumbling through the interior of the combustion chamber and reaches the combustion chamber outlet at a prescribed speed in the form of residue that falls from the outlet. The heat produced by this combustion inside the combustion chamber is transmitted through the combustion chamber wall to heat the raw material feed in the surrounding calcination chambers. High-temperature gas that exits from the combustion chamber outlet flows into the calcination chambers from the corresponding lower end openings thereof, which are in communication with the combustion chamber outlet as mentioned above. The high-temperature gas then proceeds to rise along the interior of each calcination chamber toward the inlet thereof, thus moving countercurrent to the flow of raw material feed in the combustion chamber. The combustion residue that drops from the lower end of the combustion chamber is successively discharged through the discharge pipe connected thereto.

In the embodiment where the auxiliary combustion chamber is provided below the outlet of the combustion chamber, any unburnt substances contained in the residue are discharged after being fully combusted by combustion air fed into the auxiliary combustion chamber. The high-temperature gas thus obtained joins the high-temperature gas from the combustion chamber outlet and, hence, flows into the calcination chambers from their lower end openings. The result is more effective utilization of thermal energy.

Meanwhile, the raw material feed inside the calcination chambers flows toward the corresponding outlets while being stirred and tumbled upon itself by revolution of the kiln body. In the course of travelling along the calcination chambers, the feed is heated and calcined by the heat transmitted from the combustion chamber to the calcination chamber wall surfaces, as described above, and by the high-temperature gas moving from the lower end openings of the calcination chambers to their inlets in a flow countercurrent to that of the feed. The material calcinated by this process reaches the outlet of each calcination chamber and drops. In the embodiment where the curing chamber is provided, the calcinated material falls into the curing chamber for being cured by the inherent sensible heat. The material then proceeds to fall into the cooling chamber from which it is subsequently extracted in the form of a final product through the extraction pipe.

Other features and advantages of the present invention will be apparent from the following description taken in conjunction with the accompanying drawings, in which like characters designate the same or similar parts throughout the figures thereof.

DESCRIPTION OF THE PREFERRED EMBODIMENT

Figure 1:
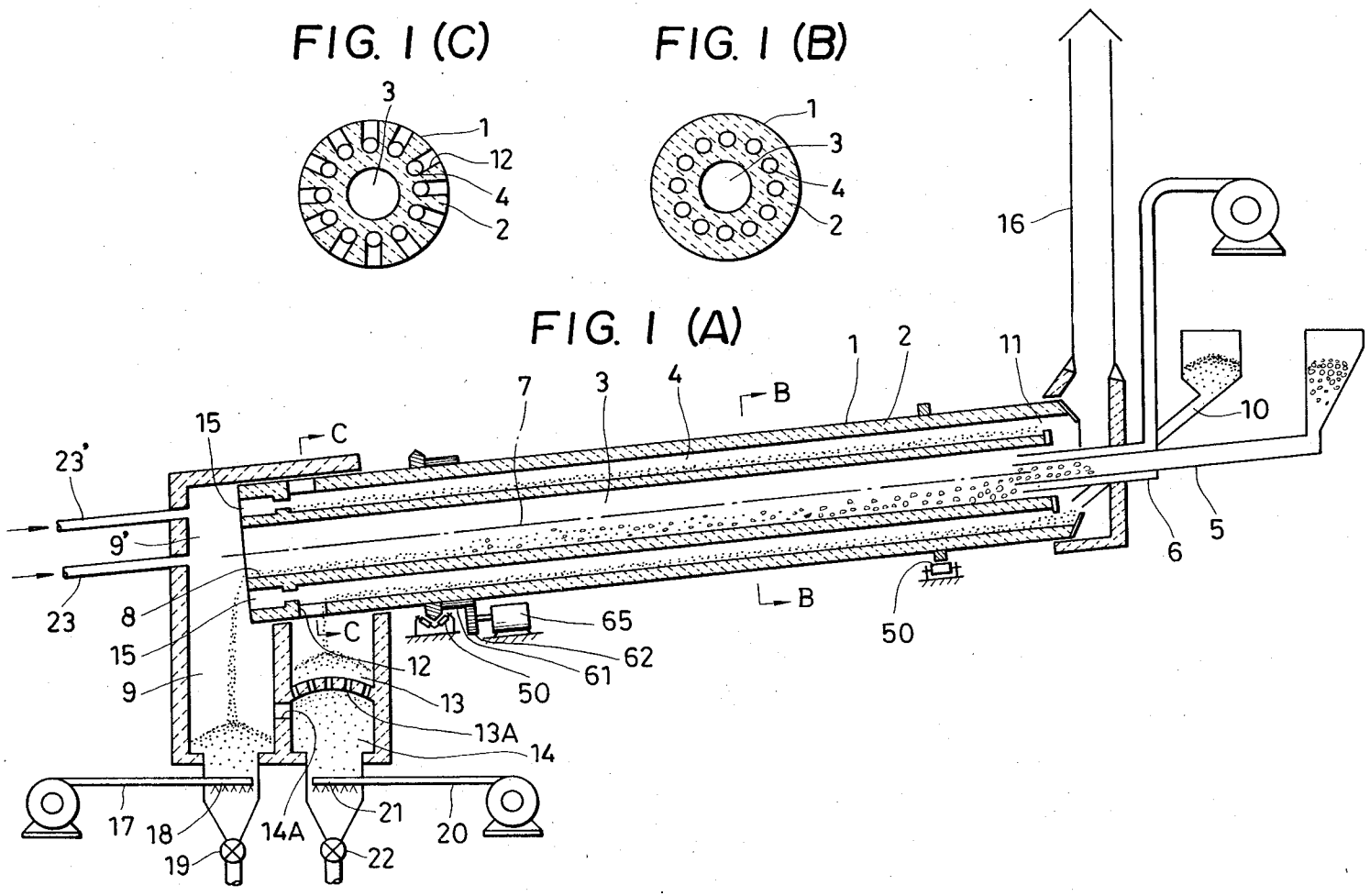
FIG. 1(A) is a longitudinal sectional view illustrating a first embodiment of a rotary kiln according to the present invention.
FIGS. 1(B) and 1(C) are sectional views taken along lines B—B and C—C, respectively, of FIG. 1(A)

As shown in FIG. 1(A), a first embodiment of a rotary kiln according to the present invention comprises a cylindrical kiln body 1 consisting of a material exhibiting a high degree of heat transfer and temperature resistance. The kiln body 1 is journalled by bearings 50 in such a manner that its central axis 7 is inclined at a prescribed angle to the horizontal. The kiln body 1 is revolved at a set speed by a motor 65 acting through gears 61, 62.

The kiln body 1 is formed to include a combustion chamber 3 coaxial with the central axis 7 and defining a bore extending therealong, and a plurality of calcination chambers 4 surrounding the combustion chamber 3 and extending in parallel relation therewith, each calcination chamber 4 defining a hollow passageway. As shown in FIGS. 1(B) and 1(C), which are sectional views of the kiln body 1 taken along lines B—B and C—C of FIG. 1(A), respectively, the combustion chamber 3 and calcination chambers 4 in the present embodiment are circular in cross section.

The temperature resistant material used to fabricate the kiln body 1 is not limited to a material of only one kind. For reasons of economy and thermal efficiency, a preferred arrangement is to employ a combination of two or more materials. As an example, a material exhibiting high temperature resistance and high thermal conductivity should be used in that part of the kiln body adjacent the central axis, and a material of a lower temperature resistance but which is a good temperature insulator should be employed in the portion of the kiln body near its outer surface.

Figure 2:
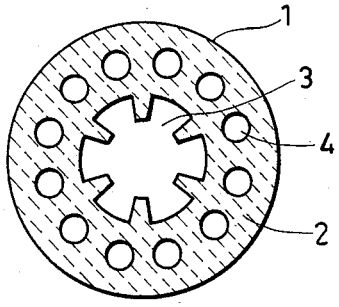
FIGS. 2(A) and 2(B) are sectional views showing modifications of the cross-sectional configuration of a kiln body included in the arrangement of FIG. 1.
Figure 2:
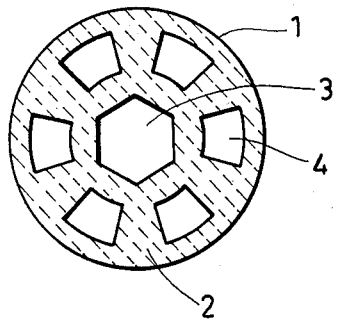

It should be noted that the combustion chamber 3 and calcination chambers 4 are not limited to the circular cross-sectional configuration of FIGS. 1(B) and 1(C), so long as these chambers are generally cylindrical. Modifications of the cross-sectional shape of these chambers are as illustrated in FIGS. 2(A) and 2(B), in which the combustion chamber 3 or calcination chambers 4 or both may be formed to have corner portions to facilitate the stirring of the materials that travel along these chambers as the rotary kiln body 1 is revolved.

Returning to FIG. 1, there is shown a fuel supply pipe 5 penetrating the inlet to the combustion chamber 3 of kiln body 1 at the elevated end thereof, which is located on the right side in the illustration. An air delivery pipe 6 is provided surrounding the fuel supply pipe 5 for feeding combustion air into the combustion chamber 3. A packing is provided between the outer circumferential portion of the air delivery pipe 6 and the end portion of the inlet to the combustion chamber 3 to prevent the outflow of combustion gases from the combustion chamber 3 and the inflow of air from the kiln surroundings.

Each of the calcination chambers 4 surrounding the combustion chamber 3 has an opening 15 at its lowermost end, a separate, radially extending opening 12 formed in its side wall at a position adjacent to the end opening 15, and an inlet 11 at its elevated end. The opening 12 serves as an outlet from which a calcined material drops at the end of its downward travel along the calcination chamber. A raw material feed pipe 10 for feeding in a raw material to be calcined is arranged to confront the elevated end of the kiln body 1 at a portion below the end of the combustion chamber 3.

A curing chamber 13 for receiving the calcined material that drops from the outlets 12 of corresponding calcination chambers 4 is provided beneath the kiln body 1 near its lower end portion so as to surround the outlets 12 as each one arrives at the position of the curing chamber 13 owing to revolution of the kiln body 1. Formed below the curing chamber 13 and communicating with it via a grating 13A is a cooling chamber 14. An air delivery pipe 20 has its distal end led into the cooling chamber 14 for feeding in cooling air jetted from dispersing means 21 provided at said distal end. Formed in the side wall of the cooling chamber 14 at the upper portion thereof is a passageway 14A communicating with an auxiliary combustion chamber, described below. A valve 22 for extracting the calcined material as a final product is provided at the lowermost portion of the cooling chamber 14.

The lower end of the combustion chamber 3 has an outlet 8 from which combustion residue falls. The aforementioned auxiliary combustion chamber, indicated at numeral 9, is provided at the lower end of the kiln body 1 to one side of the curing chamber 13. The auxiliary combustion chamber 9 completely encloses the outlet 8 of combustion chamber 3 and the lower end opening 15 of each calcination chamber 4 within a space 9' defined at the upper portion of the chamber 9, and is adapted to receive at its lower portion the combustion residue that drops from the outlet 8. An air delivery pipe 17 has its distal end led into the auxiliary combustion chamber 9 for feeding in combustion air jetted from dispersing means 18 at said distal end for the purpose of completely burning any uncombusted substances contained in the residue received in the auxiliary combustion chamber 9. The latter is also provided with a valve 19 for successively discharging the residue from the chamber. The side wall of the auxiliary combustion chamber 9 is penetrated by air delivery pipes 23, 23', which confront the outlet 8 of combustion chamber 3 and the lower end opening 15 of calcination chamber 4, respectively, for feeding in combustion air. A flue 16 the lower end of which surrounds the elevated end of the kiln body 1 extends upwardly from the kiln for carrying off excess heat and combustion gas.

A calcination operation performed by the rotary kiln of the present embodiment will now be described. First, the fuel used is a solid combustible substance of any range of particle diameters or particle diameter distribution whether in the form of finely divided powder, granules or lumps. Examples of the solid combustible substance are coal, brown coal, lignite and peat, or solid wastes such as common waste, industrial waste and agricultural waste. The fuel is supplied continuously into the combustion chamber 3 from the elevated end thereof through the fuel supply pipe 5 and is burned inside the combustion chamber 3 as combustion air is fed into the chamber through the surrounding air delivery pipe 6. Any method of supplying the fuel via the fuel supply pipe 5 may be adoped. Examples include use of a well-known screw-type feeder, pusher-type feeder or pneumatic feeder using air. The air delivery pipe 6 may be positioned as desired, and any number thereof may be employed.

The kiln body is revolved at a rate of 0.1–30 rpm around the central axis 7, which is inclined at an angle of 0.2°–10° with respect to the horizontal. As a result, the fuel supplied to the combustion chamber 3 is burned while being brought into contact with the stream of air fed in from the air delivery pipe 6, during which time the fuel descends along the combustion chamber 3 towards its lower end. Ash and unburnt substances produced as a result of burning the fuel are discharged from the outlet 8 of the combustion chamber 3 and fall into the auxiliary chamber 9. A considerable proportion of the thermal energy, namely an amount corresponding to 10–70% of the total calorific value of the fuel, produced by the combustion inside the combustion chamber 3 is transmitted through the temperature-resistant material separating the combustion chamber 3 from the calcination chambers 4, thus heating the raw material feed travelling along the calcination chambers 4 toward their corresponding outlets 12.

The raw material to be calcined, such as a loose bulk material in solid form, is fed from the raw material feed pipe 10 into the inlet 11 at the elevated end of each calcination chamber 4. Since the plural calcination chambers 4 revolve around the central axis 7, each of the calcination chambers 4 is supplied with approximately the same amount of raw material. While being calcined by the application of heat, the raw material in each calcination chamber 4 advances toward the outlet 12 owing to rotation of the kiln body 1 around the inclined central axis 7 and, following calcination, drops into the curing chamber 13 from the outlet 12. It is noteworthy that all of the calcined raw material drops from the outlets 12 of the calcination chambers 4, so that none of the raw material is capable of reaching the auxiliary combustion chamber 9 from the lower end openings 15. Thus, the calcined raw material piles up in the curing chamber 13 in isolation from the combustion residue that accumulates in the auxiliary combustion chamber 9.

High-temperature combustion gases discharged from the outlet 8 of the combustion chamber 3 pass through the space 9' at the upper portion of auxiliary combustion chamber 9 and flow into the lower end opening 15 of each calcination chamber 4 to travel upward toward the calcination chamber inlet 11 countercurrent to the flow of raw material feed inside the calcination chamber, thereby heating and calcining the feed. The combustion gases reach the inlet 11 at reduced temperature and are exhausted through the flue 16. Note that no harm is done even though the combustion gases that flow into the space 9' at the upper end of auxiliary combustion chamber 9 from the outlet 8 of combustion chamber 3 contain hydrogen, carbon monoxide and such hydrocarbons as methane.

The residue which falls into the auxiliary combustion chamber 9 forms a layer and is likely to contain unburnt substances. Here the residue is allowed to burn substantially completely by the air fed in from below via the air delivery pipe 17 and dispersing means 18. The high-temperature combustion gases so produced and the high-temperature combustion gases that exit from the combustion chamber 3 mix inside the space 9' at the upper portion of the auxiliary combustion chamber 9 and flow into the calcination chambers 4 from their respective lower end openings 15. Ash that remains from almost complete combustion of the fuel is removed through the valve 19.

The calcined material that falls into the curing chamber 13 forms a layer possessing inherent sensible heat, which almost completely calcines the material by curing action. The calcined material, which drops into the cooling chamber 14 through the grate 13A, is cooled in the cooling chamber 14 by cooling air jetted from the dispersing means 21. The calcined material thus cured and cooled is extracted as a final product via the valve 22.

Air heated by the heat exchange with the calcined material in the cooling chamber 14 enters the auxiliary combustion chamber 9 through the passageway 14A communicating the two chambers and, hence, mixes with the high-temperature combustion gases inside the auxiliary combustion chamber 9.

Note that if it is necessary to adjust the amount of air and the temperature inside the combustion chamber 3 and calcination chambers 4, the required amount of air can be introduced by the air delivery pipes 23, 23' arranged in the wall of the auxiliary combustion chamber 9 at the space 9'.

It should be noted that the foregoing description is meant to illustrate one embodiment of the present invention but does not limit the invention to the embodiment. For example, in a second embodiment of the present invention illustrated in FIG. 3, a heat exchanger 24 having an inlet 25 is arranged in the cooling chamber, indicated at numeral 14', and air is fed through the heat exchanger 24 from the inlet 25 to perform a heat exchange with the calcined material. The resulting heated air inside the heat exchanger 24 flows out through an outlet 26 and is fed into the space 9' at the upper end of the auxiliary combustion chamber 9 via the air delivery pipes 23, 23'. This arrangement provides much higher thermal efficiency. Note also that the cooling chamber 14' does not communicate with the auxiliary combustion chamber 9 directly, as does the cooling chamber 14 of the first embodiment. Rather, the curing chamber, here shown at numeral 13', is formed to communicate with the auxiliary combustion chamber 9 via a passageway 27 so that the heat given off by the calcined material that drops from the calcination chamber outlet 12 may enter the auxiliary combustion chamber 9 and mix with the high-temperature combustion gases therein.

Figure 4:
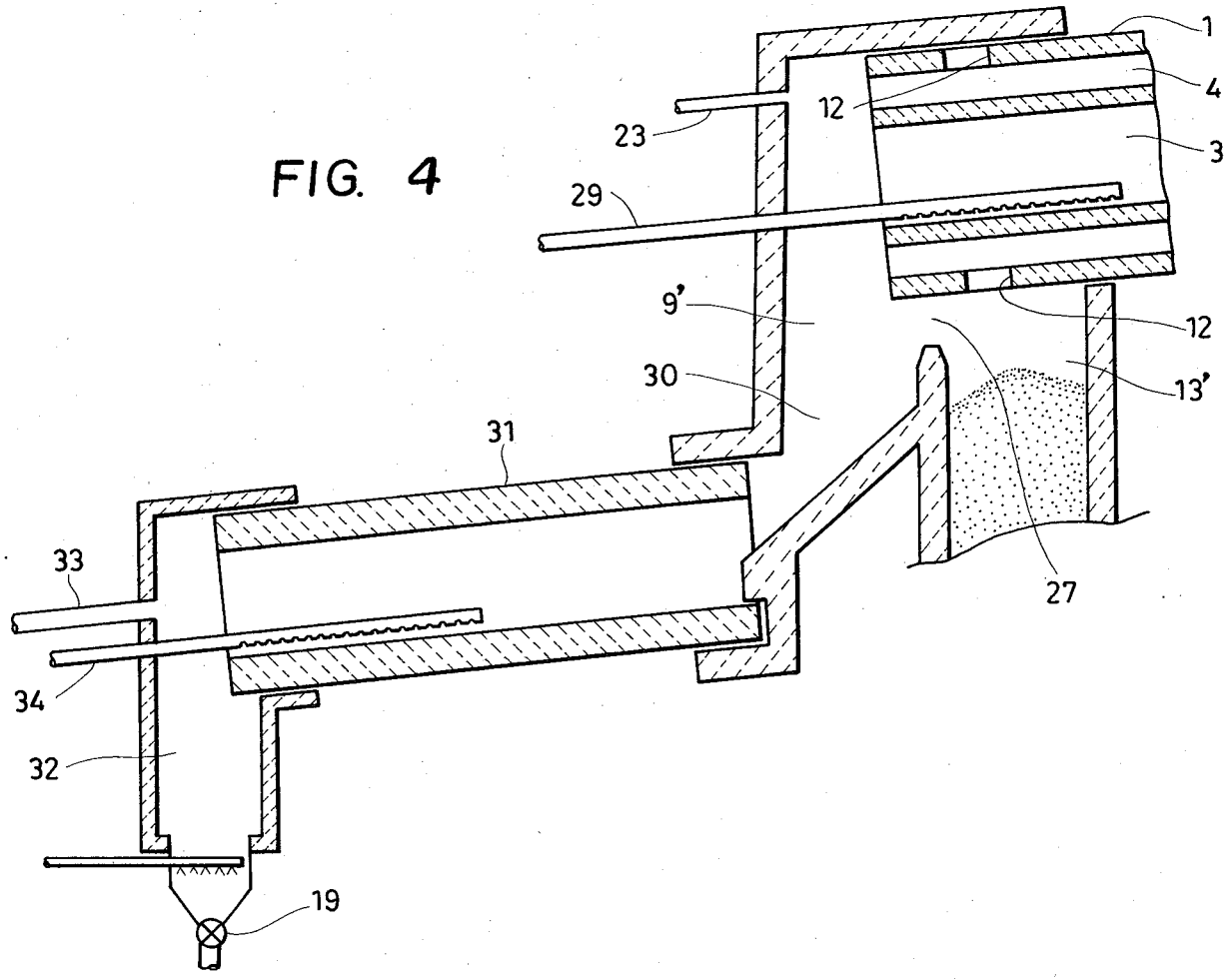
FIG. 4 is a partial longitudinal sectional view illustrating a third embodiment of a rotary kiln according to the present invention.

A third embodiment of the present invention illustrated in FIG. 4 includes a conduit 29, made of a temperature resistant material, which is inserted into the interior of the combustion chamber 3 from its outlet for feeding in air from the outside of the auxiliary combustion chamber 9. Some or all of this air can be used to burn the surface or, preferably, the interior, of an unburnt hydrocarbon-containing ash layer inside the combustion chamber 3.

If some unburnt substances remain in the residue produced by the combustion in the combustion chamber 3, a rotary combustion furnace 31 for burning these substances can be used, as shown in FIG. 4. The combustion furnace 31, which is installed at an incline, has its elevated end connected to the auxiliary combustion chamber, here shown at numeral 9', via a chute 30. The lower end of the combustion furnace 31 communicates with a residue collection chamber 32. A conduit 33 opens to the wall of the residue collection chamber 32 at its upper portion for feeding in combustion air. Further, a conduit 34 made of a temperature-resistant material penetrates the wall of the collection chamber 32 and is inserted into the combustion furnace 31 to introduce air for burning the surface or, more preferably, the interior of an ash layer that forms on the inner wall of the furnace 31. The valve 19 is provided at the lowermost portion of the collection chamber 32 to discharge the accumulation of residue.

Figure 3:
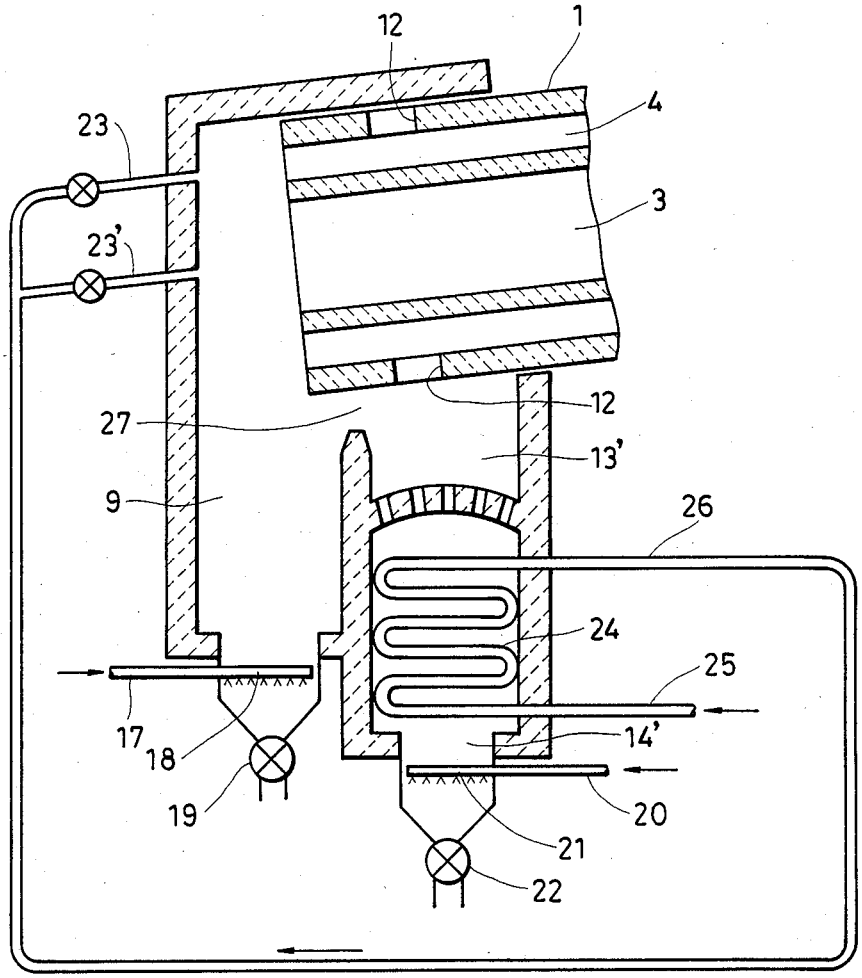
FIG. 3 is a partial longitudinal sectional view illustrating a second embodiment of a rotary kiln according to the present invention.

Arrangements for combusting unburnt substances are not limited to the embodiments of FIGS. 3 and 4. For example, use can be made of such combustion equipment as a chain stoker, stage stoker or fluidized bed combustion apparatus.

The rotary kiln of the present invention has a number of important advantages. First, no particular limitation is placed upon the fuel used, for the kiln accepts fuels of a wide variety of types and particle diameters. Accordingly, fuels unsuited for use in conventional rotary kilns of the type described hereinabove can be employed, thus broadening the application of such rotary kilns. Second, thermal efficiency is outstanding. The raw material feed is elevated in temperature by heat transmitted from the combustion chamber and by the high-temperature combustion gases made to flow from the auxiliary combustion chamber into the calcination chambers from their respective lower end openings in a direction counter to the travelling direction of the raw material, these combustion gases being obtained from the almost complete combustion of unburnt residue in the auxiliary combustion chamber. Accordingly, most of the thermal energy possessed by the fuel is used in calcination, thus contributing to conservation of resources. Third, the combustion gases that flow into the calcination chambers from their respective lower end openings contain no residue. This prevents any deterioration in the quality of the final calcined product, as is caused in the prior art by contact between such residue and the calcined material.

As many apparently widely different embodiments of the present invention can be made without departing from the spirit and scope thereof, it is to be understood that the invention is not limited to the specific embodiments thereof except as defined in the appended claims.

What we claim is:

1. A rotary kiln comprising:

a cylindrical kiln body supported for rotation about a central axis inclined with respect to a horizontal plane;

a generally cylindrical combustion chamber formed inside said kiln body and extending along the central axis, said combustion chamber having an inlet at an elevated end thereof for receiving a supply of fuel and an outlet at a lower end thereof for discharging residue produced by combustion of the fuel inside said combustion chamber, the residue dropping from said outlet; and a plurality of generally cylindrical calcination chambers formed inside said kiln body so as to lie parallel with and surround said combustion chamber, each one of said calcination chambers having an inlet at an elevated end thereof for receiving a supply of raw material to be calcined inside said calcination chamber, an opening at a lowermost end thereof, and an outlet adjacent the lowermost end thereof for discharging the raw material calcined inside said calcination chamber, said raw material dropping from said outlet;

the outlet of said combustion chamber communicating with the opening at the lowermost end of each of said calcination chambers.

2. The rotary kiln according to claim 1, further comprising an auxiliary combustion chamber provided below and surrounding the outlet of said combustion chamber for receiving the residue that drops from said outlet, said auxiliary combustion chamber having a pipe for feeding in combustion air.

3. The rotary kiln according to claim 1, further comprising:

a curing chamber provided below and surrounding the outlet of said calcination chamber for receiving the calcined material that drops from said outlet, and a cooling chamber provided below and communicating with said curing chamber for receiving and cooling the calcined raw material from said curing chamber.

4. The rotary kiln according to any one of claims 1, 2 or 3, wherein at least one of said combustion chamber and said calcination chambers has a cross section, taken at right angles to the central axis, which includes a corner portion.

5. The rotary kiln according to any one of claims 1, 2, 3 or 4, wherein at least one of the outlet of said combustion chamber and the openings at the lowermost ends of said calcination chambers is confronted by an air delivery pipe for delivering combustion air from outside the rotary kiln.

6. The rotary kiln according to claim 5, wherein said cooling chamber is provided with a heat exchanger for introducing cooling air, said heat exchanger having an outlet connected to said air delivery pipe.

7. The rotary kiln according to claim 2, further comprising a combustion furnace provided below said auxiliary combustion chamber for combusting unburnt substances contained in the residue.

* * * * *